United States Patent [19]

Shirai

[11] Patent Number: 4,560,231

[45] Date of Patent: Dec. 24, 1985

[54] ELECTRICAL CONNECTOR

[75] Inventor: Kazuo Shirai, Yokohama, Japan

[73] Assignee: Elco International K.K., Yokohama, Japan

[21] Appl. No.: 473,924

[22] Filed: Mar. 10, 1983

[51] Int. Cl.[4] ..... H01R 11/22; H01R 13/11

[52] U.S. Cl. ..... 339/258 RR; 339/256 R; 339/258 R

[58] Field of Search ..... 339/256 R, 256 SP, 258 R, 339/258 F, 258 P, 258 S, 6 S, 258 RR

[56] References Cited

U.S. PATENT DOCUMENTS

| | | | |
|---|---|---|---|
| 3,717,841 | 2/1973 | Mancini | 339/258 R |
| 3,729,701 | 4/1973 | Smith | 339/258 S X |
| 3,757,284 | 9/1973 | Klehm, Jr. | 339/221 R X |
| 3,850,500 | 11/1974 | Cobaugh et al. | 339/258 R |

FOREIGN PATENT DOCUMENTS

| | | | |
|---|---|---|---|
| 2615820 | 10/1977 | Fed. Rep. of Germany | 339/258 RR |

OTHER PUBLICATIONS

R. D. Cargill et al., "Electrical Connector", *IBM Technical Disclosure Bulletin,* vol. 4, No. 8, Jan. 1962.

F. V. Legge et al., "Slip-On Electrical Connector", *IBM Technical Disclosure Bulletin,* vol. 12, No. 8, Jan. 1970.

*Primary Examiner*—Gil Weidenfeld

*Assistant Examiner*—Steven C. Bishop

*Attorney, Agent, or Firm*—A. Thomas Kammer

[57] ABSTRACT

An electrical contact is provided for receiving a pin contact therein. It includes a receptacle having an elongate spring member positioned therein. A pair of resilient tabs having downwardly projecting contact points define the upper portion of the receptacle. The elongate spring member includes a pair of upwardly extending contact points. A pin contact is inserted between the tabs and the spring member. A projection extending from a side wall of the receptacle limits the deflection of the spring member upon insertion of the pin contact. A plurality of electrical contacts as described above may be incorporated within an insulator to provide a connector.

13 Claims, 7 Drawing Figures

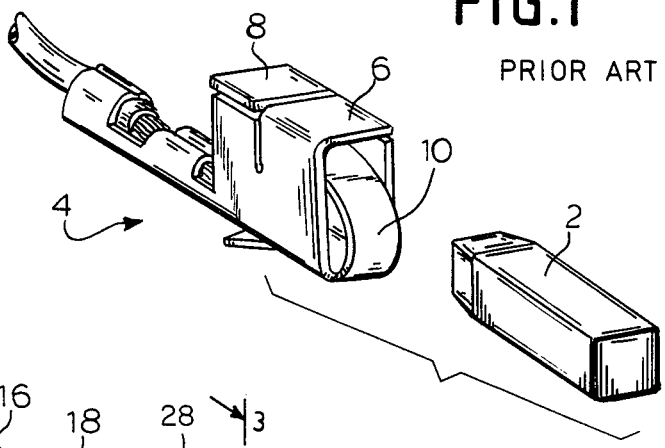
FIG.1
PRIOR ART
FIG.2
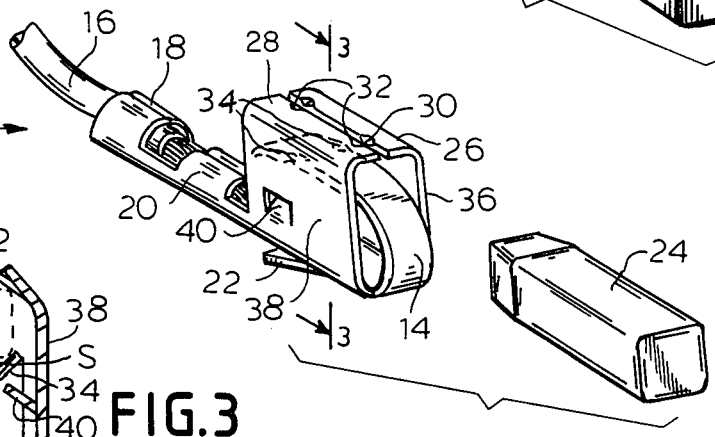
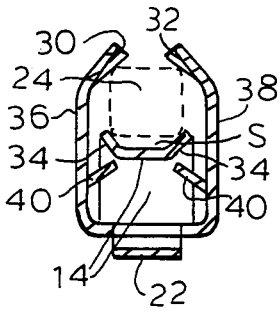
FIG.3
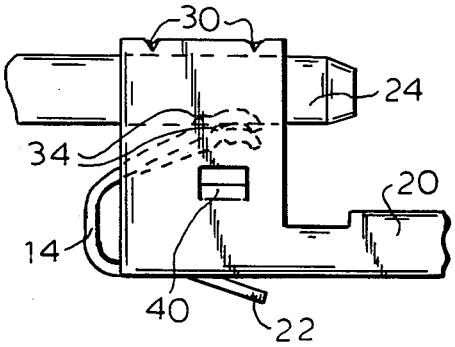
FIG.4
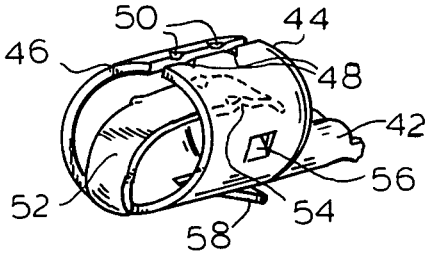
FIG.5

ELECTRICAL CONNECTOR

BACKGROUND OF THE INVENTION

1. Field of the invention

The field of the invention relates to a connector having a receptacle portion for receiving a male member such as a pin contact.

2. Brief Description of the Prior Art

Electrical connectors for mating with a plurality of square posts or pins are well known in the electronics field. Referring to FIG. 1, a contact of one such prior art connector assembly is shown including a pin or plug type contact 2 which may be inserted within a female contact 4. A pair of upper transversely extending spring members 6 and 8 are arranged on the upper side of the contact to provide a resilient force in the downward direction upon a pin inserted therein. An elongated member 10 which is bent inwardly into the contact body in the longitudinal direction thereof is arranged on the lower surface of the contact. While the inner width of the body is dimensioned such that the square pin contact 2 fits therein, the height of the inner side (i.e. the distance between the inner surface of members 6,8 and the upper surface of the elongated member 10) is made smaller than one side thereof. As a result, when the pin contact is inserted into the receptacle portion of the contact body, the spring members 6,8 apply a downwardly resilient force thereon and the contact pressure is controlled by the elongated member. When the contact is made from a conventional metal such as brass or phosphoric bronze rather than a precious metal such as gold or platinum, and is employed in a low voltage circuit, vibrations or shocks can create serious problems in the electrical connection between the female contacts and square pins positioned therein.

Although the contact surfaces of a connector are generally covered by a thin film of oil used in the manufacturing process and/or a thin oxide layer formed by a natural oxidation of the metal, the insertion type connector forms a conductive contact by means of a wiping action which breaks the oil film or the oxide layer by contact pressure at the time the pin is inserted into the receptacle. Even if a thin oil film or oxide layer exists between the contact points, an electrical connection is established by a tunnelling effect or a fretting action which breaks through it due to the applied voltage.

If the connector or contact portions are used for a substantial period of time in a vibrationary environment, the electrical connections will deteriorate. Regardless of contact types such as a plane contact, line contact, or point contact, the metal or plated surface of the contact is quite irregular when viewed microscopically. Thus, when a pin and a receptacle are connected to each other, conduction is possible by means of metallic fusion or similar connections of many contact points between the pin and the receptacle. The contact portions "cleaned" by the wiping action, however, are oxidized promptly thereby forming an insulating layer on the surfaces thereof. When the contact points are disturbed due to vibrations, new contact points are created due to the action described above, while the former contact points are oxidized and promptly form an oxide layer as explained above. Thus, when the shifting of the contacts repeatedly occurs, the oxide portions build rapidly to produce a black powdered oxide material which finally results in non-conductivity.

In order to avoid the problems set forth above, means may be employed for inhibiting relative movement between the pin and receptacle and for maintaining an air tight connection therebetween. However, an increased contact pressure or an increased contact area results in difficulty of insertion of withdrawal. In addition, increased contact pressure increases abrasion of the plated surfaces of the connector. Where a mass termination type connector is employed, the pressure exerted upon each pin is preferably made as small as possible to facilitate insertion or withdrawal. Further, the contact pressure should not be excessive to avoid damaging the locking tabs engaging the contacts in the insulator when the male connector is pulled out. Still further, in case a "wrenching" occurs wherein a pin contact is inserted or withdrawn at an angle from the connector, the elongated member (tongue member) may be deflected beyond its elastic limit resulting in permanent deformation of the curved portion thereof.

SUMMARY OF THE INVENTION

A principal object of the invention is to provide an electrical connector having a contact construction which allows easy insertion and withdrawal of a male member while avoiding the above-mentioned problems under vibrationary conditions.

Another object of the invention is to provide a contact having an elongated member portion which is maintained within its elastic limit even upon insertion of a pin contact non-axially with respect thereto.

In accordance with one embodiment of the invention, the contact has a longitudinal body portion including a pair of opposing resilient tabs. An elongate spring member extends longitudinally in the direction of contact pin insertion. Each tab includes an inwardly projecting contact point. The elongate spring member includes a contact point extending towards the resilient tabs. The contact points are arranged so as to center a pin contact inserted therebetween.

A projecting member extending inwardly from the contact body may be provided to limit the deflection of the elongate spring member and thereby prevent damage thereto.

BRIEF DESCRIPTION OF THE DRAWINGS

FIG. 1 is a perspective view of a prior art contact and pin;

FIG. 2 is a perspective view of a contact and pin according to the present invention;

FIG. 3 is a sectional view thereof upon insertion of a pin;

FIG. 4 is a side elevation view thereof;

FIG. 5 is a perspective view of an alternative embodiment of the invention;

DETAILED DESCRIPTION OF THE INVENTION

Figure 6:
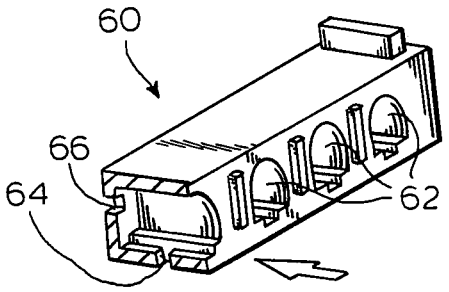
FIG. 6 is a sectional perspective view of an insulator employed with the invention.

A first embodiment of the invention is shown in FIG. 2. An electrical contact 12 for connecting a terminated cable to a square pin or post is provided. The contact is stamped or punched from thin metallic material such as phosphoric bronze or brass. It is preferably tin plated.

The contact includes an elongate, substantially rectangular body having an elongate spring member 14 extending from the front bottom portion thereof. This spring member 14 extends rearwardly within the body generally parallel to the longitudinal axis thereof. A wire grasping section is integrally mounted to the contact body for retaining a wire or cable 16. Two pairs of wire grasping tabs 18,20 are provided, the first 18 for holding an insulated portion of the cable, the second 20 for crimping the non-insulated end thereof. A locking tab extends from the bottom surface of the contact body for securing it to an insulator.

The inside dimensions of the contact 12 are made slightly smaller than the size of the pin contact 24 to provide a resilient force to the pin in the direction of its center portion. The contact 12 has two inwardly extending resilient tabs 26 and 28 which are arranged in opposing relation and in parallel with the direction of insertion of the pin contact. The tabs define the upper portion of the contact body.

Two pairs of triangular projections 30 and 32 extend from the inner edges of tabs 26 and 28 respectively towards the interior of the contact body. The projections are in opposing relation to each other. Together with the upper edges of the pin 24, the small sloped portions defined by these projections firmly hold the pin 24 and at the same time act as electric contact points. The elongate spring member 14 curves inwardly within the contact body in the direction of pin insertion. It extends from the lower portion of the resilient cylinder and defines a lower contact surface. A pair of triangular projections or contact points 34 extend upwardly from the edges of the spring member 14. As shown in section in FIG. 3, member 14 and the projections 34 define a concave surface and the projections 30,32 and 34 and the edges of pin contact 24 act as electrical contact points. The horizontal distance between the electric contacts 34 is made wider than the width of the pin 24 so as to form an air gap (S) between the spring member 14 and the lower surface of the pin 24. As shown in FIG. 4, contact points 34 are arranged between the electric contact points 30 and 32 from a longitudinal (side elevation) view of the contact 12.

A pair of opposing flap members 40 extend inwardly from the contact body side walls 36 and 38. They are symmetrically arranged below spring member 14 to limit the movement thereof and thereby prevent bending beyond the elastic limit when inserting or withdrawing the pin contact.

An insulator 60 for receiving a plurality of contacts such as the one discussed above is shown in FIG. 6. When inserted within one of the holes 62 in the insulator, the tip of locking tab 22 snaps within an aperture 64 provided in a lower wall thereof. The contact 12 is thereby locked within the hole 62.

When a pin 24 is inserted within the contact 12 as shown in FIG. 3, it is centered horizontally by the combined action of the contact points 30,32,34. Contact points 30,32 provide horizontal centering while spring member 14 and its points 34 provide vertical centering. The resilient stabilizing of the pin contact in both directions results in superior electrical contact even when subjected to shocks or vibrations. The air gap S between the pin contact 24 and the upper surface of spring member 14 as well as the space between the inner edges of tabs 26,28 are also important in this regard.

Since the contact areas between the pin 24 and contact 12 are small, insertion and withdrawal can be smoothly accomplished. Flap members 40 prevent damage to spring member 14 thereby insuring good contact even after a pin contact has been improperly employed therein.

A second embodiment of the invention is shown in FIG. 5. It includes a substantially cylindrical contact body having a cable grasping section 42 extending therefrom. Portions of the contact body define a pair of opposing resilient tabs 44,46 having a longitudinal gap therebetween. Two pairs of opposing triangular projections 48,50 extend inwardly from the inner edges of the tabs.

An elongate spring member 52 which bends in the slide-in direction of the contact extends beneath the tabs 44,46. Triangular electrical contact points 54 are provided on the upper edge portions of the elongate member and are made by pressing. A projection 56 limits the strain on member 52 to maintain it within the elastic limit. A locking member 58 is provided for securing the contact to an insulator. The construction of this cylindrical contact has basically the same functions as the contact illustrated in FIG. 2 which can be used with either square or round pin contacts.

As compared with conventional contacts having surface contacts without any definite contact points, the cylindrical connector in accordance with the invention provides easy connections, avoids the formation of an oxide material thereon, establishes a stabilized electrical contact, and maintains a steady holding of the pin against outside forces in various directions. A tin-plated contact assembly employed in relatively low voltage and current applications is particularly effective in overcoming the problems associated with prior art contacts.

Figure 7:
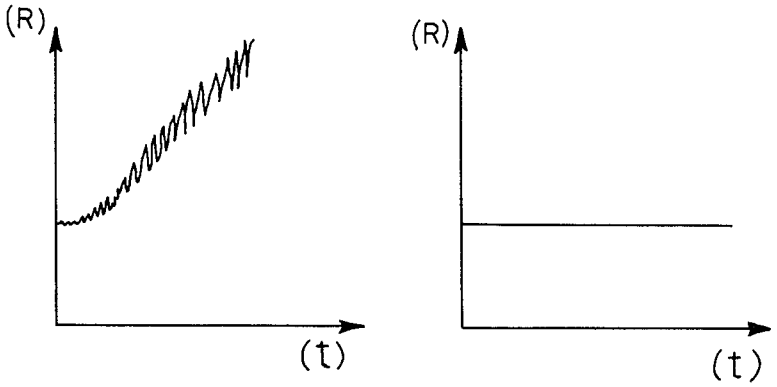
FIG. 7 provides a pair of graphs illustrating the relative performances of a prior art contact and one according to the invention.

A pair of graphs are provided in FIG. 7 for illustrating the resistance of a contact as a function of the time it is subjected to vibrations. The graph on the left shows the results for a prior art contact while the one on the right concerns a contact according to the present invention.

What is claimed is:

1. An electrical contact comprising:

a longitudinal body for receiving a pin contact and including first and second inwardly projecting resilient tabs in opposing relation to each other, a bottom portion, and opposing side walls connecting said tabs and said bottom portion;

an elongate spring member secured to said body and extending longitudinally therein in the direction of insertion of a pin contact, said elongate spring member having an upper surface in opposing relation to said first and second resilient tabs such that a pin contact may be inserted therebetween;

a first pair of contact points extending from said first resilient tab and within said body;

a second pair of contact points extending from said second resilient tab in opposing relation to said first pair of contact points and within said body;

a third pair of contact points extending from said elongate spring member and toward said resilient tabs, said third pair of contact points being positioned between said first and second pairs of contact points in the longitudinal direction;

said contact points being arranged to engage a pin contact upon its insertion within said body between said resilient tabs and said elongate spring member; and a projection extending from one of said side walls of said body, said projection being positioned beneath said spring member to limit the distance it can deflect upon insertion of a pin contact within said body and above said bottom portion.

2. An electrical contact as defined in claim 1 wherein each of said first and second pairs of contact points extends from an edge portion of said respective resilient tabs.

3. An electrical contact as defined in claim 2 wherein each of said contact points is formed by a triangular impression formed within the tabs and elongate spring member, respectively, said spring member contact points and said upper surface of said spring member defining, in section, a concave surface opposing said tabs.

4. An electrical contact as defined in claim 1 wherein said tabs are integral with said body and define respective opposing edges and a longitudinal space between said edges, said first and second pairs of contact points being defined by each of said edges and in said opposing relation across said longitudinal space, said elongate spring member including a pair of longitudinal side edges, said third pair of contact points extending from said elongate spring member being defined by said edges thereof, said third pair of contact points and said upper surface of said elongate spring member defining in section a concave surface opposing said tabs.

5. An electrical contact as defined in claim 4 wherein said body includes a front end and a rear end, said elongate spring member being attached to said front end and bending back towards said rear end.

6. An electrical contact as defined in claim 5 including a cable grasping section extending from said rear end.

7. An electrical contact as defined in claim 1 wherein said body includes a longitudinal space therein separating said tabs.

8. An electrical contact as described in claim 1 wherein said body is rectangular.

9. The improvement as described in claim 1 wherein said body is cylindrical.

10. An electrical contact as defined in claim 5 wherein said third pair of contact points are each substantially the same distance from said front end of said body.

11. An electrical contact comprising:

a longitudinal body for receiving a pin contact including first and second inwardly projecting and resiliently mounted tabs integral with said body, said tabs having edges in opposing relation and defining a longitudinal space between said edges;

a pair of contact points defined by each of said edges, each of said pairs of contact points being in opposing relation across said longitudinal space;

an elongate spring member secured to said body and extending longitudinally therein in the direction of insertion of a pin contact, said spring member including upper and lower surfaces thereof being in opposing relation to said first and second tabs;

a pair of spring member contact points extending upwardly from said spring member and defined by said side edges thereof, said spring member contact points being positioned longitudinally between said pairs of contact points defined by the edges of said tabs, said spring member contact points and said upper surface of said spring member defining, in section, a concave surface opposing said tabs;

said tab and spring member contact points being arranged to engage and center a pin contact upon its insertion within said body between said tabs and said spring member.

12. An electrical contact as defined in claim 11 wherein said body includes a front end and a rear end, and said spring member contact points are each substantially the same distance from said front end of said body.

13. An electrical contact as defined in claim 11 including a pair of symmetrical projections extending from said body to a position beneath and out of contact with said spring member.

* * * * *